United States Patent [19]

Puls et al.

[11] Patent Number: 4,539,442

[45] Date of Patent: Sep. 3, 1985

[54] LOUDSPEAKER

[75] Inventors: Bernhard Puls, Mitterfels; Hermann Gruber, Hunderdorf; Kurt Leipold, Feldkirchen; Richard Schonberger, Straubing; Ulrich Kizak, Oberwinkling; Max Huttereer, Straubing-Kagers, all of Fed. Rep. of Germany

[73] Assignee: International Standard Electric Corporation, New York, N.Y.

[21] Appl. No.: 562,876

[22] Filed: Dec. 19, 1983

[51] Int. Cl.[3] ..... H04R 9/04

[52] U.S. Cl. ..... 179/115.5 VC; 174/117 FF

[58] Field of Search ..... 179/115.5 R, 115.5 VC; 174/117 FF; 336/192; 339/275 A

[56] References Cited

U.S. PATENT DOCUMENTS

| | | | |
|---|---|---|---|
| 2,526,836 | 10/1950 | Willson | 179/115.5 VC |
| 3,474,370 | 10/1969 | Lightner | 336/192 |
| 3,766,506 | 10/1973 | Gaty | 336/192 |
| 3,935,402 | 1/1976 | Gersten | 179/115.5 VC |
| 4,075,420 | 2/1978 | Walton | 174/117 FF |
| 4,465,905 | 8/1984 | Nation | 179/115.5 VC |

FOREIGN PATENT DOCUMENTS

| | | | |
|---|---|---|---|
| 3247941 | 6/1984 | Fed. Rep. of Germany | 179/115.5 VC |

*Primary Examiner*—Gene Z. Rubinson
*Assistant Examiner*—L. C. Schroeder
*Attorney, Agent, or Firm*—John T. O'Halloran; Peter R. Ruzek

[57] ABSTRACT

The moving coil (voice coil) of the loudspeaker is so designed that the loudspeaker will become suitable for automatic production. For this purpose, the moving coil is positioned on a coilform, and as a connecting line extending to the ends of the moving coil there are used flexible ribbon conductors secured to a plastics carrier.

7 Claims, 6 Drawing Figures

LOUDSPEAKER

The invention relates to a loudspeaker with a moving coil connected to a diaphragm, in which elastic ribbon conductors are used as lead in wires extending to the winding ends of the moving coil, with each of said ribbon conductors being connected, on the one hand, to the moving coil and, on the other hand, to a stationary part of the loudspeaker.

Such types of loudspeakers are known (DE-PS No. 20 35 061).

It is the object of the invention to further develop the conventional type of loudspeaker in such a way as to become suitable for automatic production.

According to the invention, this object is achieved in that the moving coil is disposed on one portion of the longitudinal dimension of a cylindrical moving-coil carrier, with at least two flexible ribbon conductors secured to a plastics carrier, being disposed on the remaining portion of the moving-coil carrier by extending parallel in relation to the longitudinal axis thereof, with the ends thereof being secured to the moving-coil carrier with the aid of a thermosetting adhesive film, and with the ends of the moving coil being connected in an electrically conductive manner to these ends of the ribbon conductors.

Preferred embodiments of the invention are set forth in claims 2 to 7, and will now be explained hereinafter with reference to FIGS. 1 to 6 of the accompanying drawings, in which:

Figure 1:
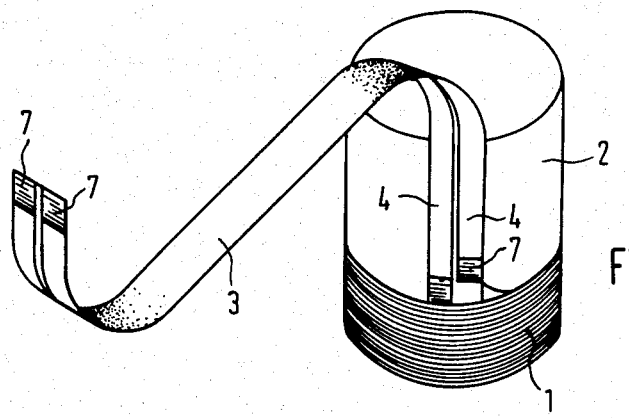
FIG. 1 is the perspective representation of the moving coil with its terminals.

FIG. 1 illustrates a moving-coil arrangement for a loudspeaker, in which the moving coil (voice coil) 1 is wound on to a cylindrical moving-coil carrier (coilform) 2. This moving-coil carrier 2 may, for example, be a tubularly shaped aluminum foil. On the other part of the moving-coil carrier 2 there are secured two ribbon conductors 4 mounted on a flexible plasticscarrier 3, with said ribbon conductors 4 consisting of an electrically well conducting metal layer, such as of copper.

Figure 2:
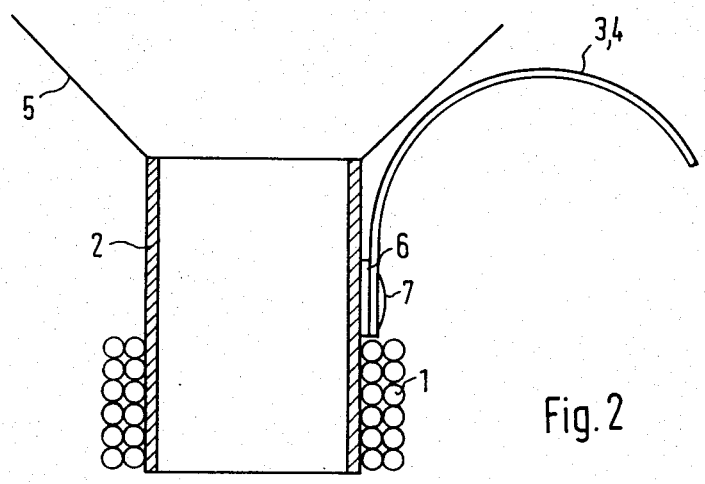
FIG. 2 is a longitudinal section taken through the moving coil.

From FIG. 2 it is recognizable in what way the plastics carrier 3 as provided with the ribbon conductors 4, is attached to the moving-coil carrier 2 as connected, for example, to the cone diaphragm 5. For this purpose, the one end of the plastics carrier/ribbon conductor arrangement, by insertion of a thermosetting adhesive film 6, is firmly connected to the moving-coil carrier (coilform) 2. The adhesive film 6, for example, may be a commercially available type of thermoplastic reaction adhesive in film form having a thickness ranging between 0.06 and 0.08 μm on a nitrile-rubber/phenolic-resin basis. Usually, the parts to be connected with the aid of such an adhesive foil, are processed in a heatable and coolable press at temperatures ranging between 100° and 200° C. and by being subjected to pressures applied thereto ranging between 0.2 and 1 N/mm$^2$.

Within the area of the connection between the plastics carrier/ribbon conductor arrangement and the moving-coil carrier (coilform) 2, the ribbon conductors 4 are provided with a flat tin solder bead 7 in order thus to facilitate the connection of moving coil ends. The other ends of the ribbon conductors 4 may likewise—as can be seen from FIG. 1,—be provided with such tin solder beads 7.

Figure 3:
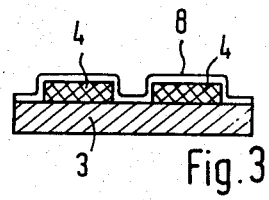
FIG. 3 shows one example of embodiment of the lead in conductor extending to the moving coil, in a cross-sectional view.

FIG. 3 shows a type of embodiment of the plastics carrier/ribbon conductor arrangement in a cross-sectional view. This arrangement consists of the plastics carrier 3 which, for example, is a polyimide foil having a thickness of 25 μm. On the plastics carrier 3 the ribbon conductors 4 are disposed, which exist, for example, of copper and have a thickness of 35 μm. Moreover, onto the plastics carrier 3 and the ribbon conductor 4 there is deposited the layer of surface lacquer 8. This layer, on the one hand, serves to insulate the ribbon conductors and provides the plastics carrier/ribbon conductor arrangement with a certain rigidity which has a vibration-damping effect.

Figure 4:
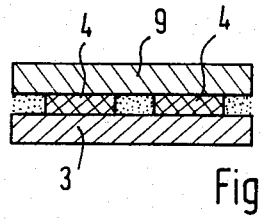
FIG. 4 shows another example of embodiment relating to the lead-in conductor.

The type of embodiment of the plastics carrier/ribbon conductor arrangement as shown in FIG. 4 differs from the one as shown in FIG. 3 in that, instead of the layer of surface lacquer 8, there is provided the polyimide cover foil 9.

Figure 5:
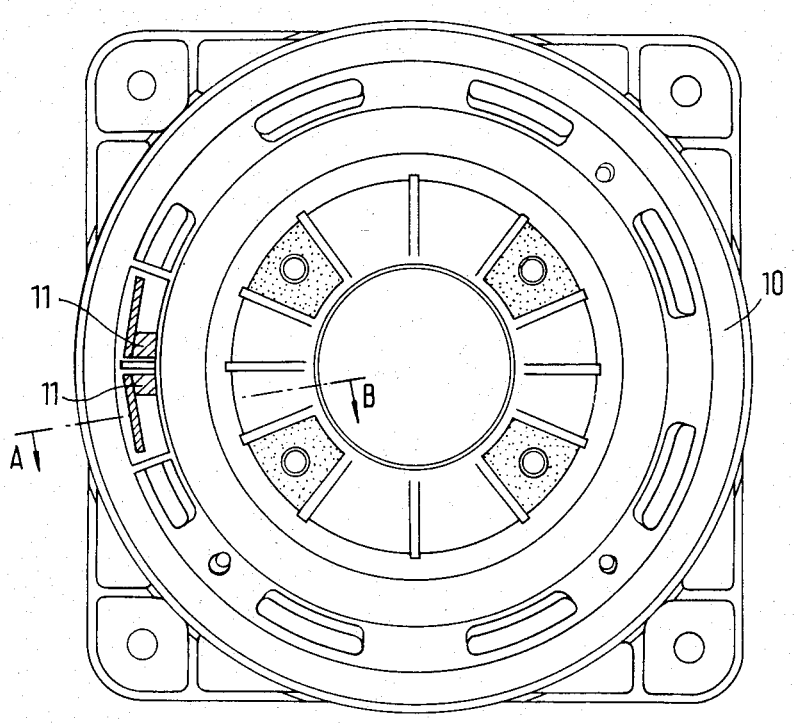
FIG. 5 is the top view of the loudspeaker basket.
Figure 6:
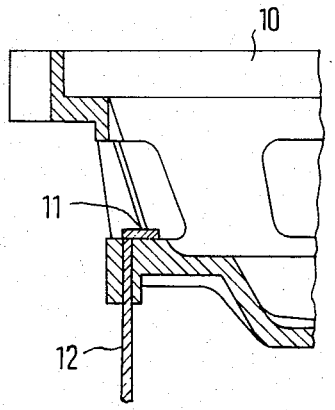
FIG. 6 is a partly sectional view taken along the line A-B of FIG. 5.

FIG. 5 shows a loudspeaker frame or basket 10 which, for example, is injection molded in one piece from plastics material and in which, when the loudspeaker is finished, the cone diaphragm is positioned. As can be seen from FIG. 5 and 6, contact members 11 are disposed in the speaker basket 10, which are so designed as to have contact surfaces 11 on the inner side, that is, on the side facing both the diaphragm and the moving coil and which, on the outside, are designed as pin contacts 12 on which, for example, socket or female contacts may be plugged. The free ends of the ribbon conductors may then be soldered, with the aid of the tin solder beads 7 (see FIG. 1) to the contact surfaces 11.

We claim:

1. Loudspeaker with a moving coil connected to a diaphragm in which elastic ribbon conductors serve as the lead in wires extending to the winding ends of the moving coil, with each ribbon conductor being connected on the one hand, to the moving coil and, on the other hand, to a stationary part of the loudspeaker, characterized in that the moving coil (1) is disposed on a portion of the longitudinal dimension of a cylindrical moving-coil carrier (2), with at least two flexible ribbon conductors (4) mounted on a plastics carrier (3) being disposed on the remaining portion of the moving-coil carrier parallel in relation to the longitudinal axis thereof, with the ends of said ribbon conductors being secured to said moving-coil carrier (2) with the aid of a thermosetting adhesive film (6), and that the ends of said moving coil are connected in an electrically conductive manner to these ends of said ribbon conductors.

2. A loudspeaker as claimed in claim 1, characterized in that the ribbon conductor (4) as secured to a plastics carrier, is a polyimide foil provided with copper leads in the way of a printed circuit.

3. A loudspeaker as claimed in claim 1, characterized in that said thermosetting adhesive film (6) is a film on the nitrile-rubber/phenolic-resin basis.

4. A loudspeaker as claimed in claim 2, characterized in that said polyimide foil provided with copper leads is topped by a polyimide cover foil (9).

5. A loudspeaker as claimed in claim 2, characterized in that on said polyimide foil provided with said copper leads, there is disposed a layer of lacquer (8).

6. A loudspeaker as claimed in claim 1, characterized in that the ends of said ribbon conductors (4) as secured on said moving-coil carrier, are staggered with respect to one another.

7. A loudspeaker as claimed in claim 6, characterized in that the other ends of said ribbon conductors are connected in an electrically conductive manner to contact devices (11) positioned on the loudspeaker basket (10).

* * * * *